US007314271B2

(12) United States Patent
Fukano et al.

(10) Patent No.: US 7,314,271 B2
(45) Date of Patent: Jan. 1, 2008

(54) PRINTING DEVICE, AND CONTROL OF PRINTING DEVICE

(75) Inventors: Takakazu Fukano, Nagano-ken (JP); Hiroaki Tojo, deceased, late of Matsumoto (JP); by Toshiko Tojo, legal representative, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 83 days.

(21) Appl. No.: 10/411,349

(22) Filed: Apr. 11, 2003

(65) Prior Publication Data

US 2003/0218651 A1 Nov. 27, 2003

(30) Foreign Application Priority Data

Apr. 12, 2002 (JP) ..... 2002-109983

(51) Int. Cl.
*B41J 2/175* (2006.01)

(52) U.S. Cl. ..... 347/86; 347/19; 347/50

(58) Field of Classification Search ..... 347/7, 347/19, 50, 68, 86
See application file for complete search history.

(56) References Cited

U.S. PATENT DOCUMENTS 5,567,063 A 10/1996 Chiu
5,652,610 A * 7/1997 Kawai et al. ..... 347/87
5,997,121 A * 12/1999 Altfather et al. ..... 347/7
6,273,541 B1 8/2001 Myung
6,312,106 B1 * 11/2001 Walker ..... 347/50
6,502,919 B1 * 1/2003 Tanabe ..... 347/23
7,213,897 B2 5/2007 Kosugi
2002/0015066 A1 2/2002 Siwinski et al.
2002/0135630 A1 * 9/2002 Kosugi ..... 347/19

FOREIGN PATENT DOCUMENTS

EP 0 844 094 A2 5/1998
EP 1 080 911 A2 * 3/2001
JP 6-155758 A 6/1994
JP 11-216878 A 8/1999
JP 2001199087 A 7/2001
JP 02-026777 A1 1/2002
WO WO 00/43932 A2 7/2000
WO WO 02-02337 A1 1/2002

* cited by examiner

*Primary Examiner*—Lam Son Nguyen
(74) *Attorney, Agent, or Firm*—Sughrue Mion, PLLC

(57) ABSTRACT

A printing device that facilitates processes requested in relation to a print recording medium reservoir. When a contact detecting switch 25 is turned on by a proximate ink cartridge CA, a personal computer PC identifies the proximate ink cartridge CA. The personal computer PC, in the event that the duration of sustained proximity of the proximate ink cartridge CA is longer than a predetermined time interval Tref, reads out the remaining quantity of ink from the memory device module M of the proximate ink cartridge CA and displays this on an external display device 40. In the event that the duration of sustained proximity is shorter than predetermined time interval Tref, the personal computer PC drives the carriage 101 so as to move an ink cartridge CA installed on carriage 101 corresponding to the proximate ink cartridge CA to a replacement opening 14.

1 Claim, 8 Drawing Sheets

PRINTING DEVICE, AND CONTROL OF PRINTING DEVICE

FIELD OF THE INVENTION

The present invention relates to a control technique for a printing device that sends and receives data, by means of a non-contact format, with a print recording medium reservoir equipped with a memory device.

BACKGROUND OF THE INVENTION

Ink cartridges equipped with a memory device for storing information, such as remaining ink quantity, have recently come into practical use. Such ink cartridges send and receive information with the printer via contacts provided to the memory device and contacts provided on the printer, enabling information such as remaining ink quantity, ink expiration date, and ink cartridge compatibility with the particular printer to be transmitted between the memory device and the printer.

Where an ink cartridge equipped with a memory device is employed, for example, in a printer that allows swapping between ink cartridges of different colors, the amount of ink remaining in the ink cartridge at the point in time at which the cartridge is swapped out can be stored in its memory device, so that when the ink cartridge is subsequently reinstalled the printer can utilize correct remaining ink information.

However, these conventional ink cartridges require direct contact between memory device contacts and printer contacts when the ink cartridge is installed in the printer, so that information such as remaining ink quantity can be read out from the memory device. Thus, once the ink cartridge has been uninstalled, it is impossible to determine the remaining ink quantity or other parameters unless the ink cartridge is reinstalled in the printer. An additional problem is that it is not possible to determine whether an ink cartridge is compatible with a particular printer unless the ink cartridge package is opened and the cartridge installed in the printer.

Yet another problem is that when an ink cartridge is installed merely for the purpose of verifying the remaining ink quantity, ink is consumed unnecessarily in the cleaning operation performed when an ink cartridge is replaced.

Accordingly, there exists a need to further simplify the ink cartridge replacement process, and through simpler means to prevent the problem of erroneous insertion when replacing ink cartridges, which can occur with swapping of ink cartridges of multiple colors.

SUMMARY OF THE INVENTION

The present invention is directed to solving the aforementioned problems, and has as an object to provide a printing device that facilitates processes requested in relation to a print recording medium reservoir. A further object is to prevent erroneous insertion when a print recording medium reservoir is replaced.

To solve the aforementioned problems, the invention in a first aspect thereof provides a printing device for sending and receiving data, by means of a non-contact format, with a print recording medium reservoir equipped with a memory device. The printing device pertaining to the first aspect herein comprises a transmitter-receiver for sending and receiving data; a proximity detecting unit for detecting proximity of a said print recording medium reservoir; an event sensor for detecting an event; a control signal issuing unit for issuing a control signal in response to detecting proximity of a said print recording medium reservoir and a said event; and an output unit for outputting said issued control signal.

According to the printing device pertaining to the first aspect herein, a control signal is issued in response to detecting proximity of a print recording medium reservoir and an event, whereby processes required in relation to a print recording medium reservoir may be carried out without the need to install the print recording medium reservoir.

A printing device pertaining to the first aspect herein may further comprise a carriage having said print recording medium reservoir installed thereon and equipped with a print head; a carriage control unit for controlling operation of said carriage; and an identifying unit for identifying said proximate print recording medium reservoir, wherein said event is the duration of sustained proximity of said print recording medium reservoir; said control signal issuing unit, in the event that said duration of sustained proximity exceeds a predetermined length of time, issues a control signal for moving said carriage to the replacement location for a print recording medium reservoir installed on said carriage, corresponding to said identified print recording medium reservoir; and said output unit transmits said issued control signal to said carriage control unit.

According to the printing device pertaining to the first aspect herein, in response to detecting proximity of a print recording medium reservoir and duration of sustained proximity thereof, a print recording medium reservoir installed on the carriage, corresponding to the identified print recording medium reservoir, is moved to a replacement location, whereby a process that is necessary to replace a print recording medium reservoir can be performed without installing the print recording medium reservoir, and erroneous insertion when replacing a print recording medium reservoir can be avoided.

A printing device pertaining to the first aspect herein may further comprise a carriage having said print recording medium reservoir installed thereon and equipped with a print head; and an identifying unit for identifying said proximate print recording medium reservoir, wherein said event is the duration of sustained proximity of said print recording medium reservoir; said control signal issuing unit, in the event that said duration of sustained proximity is shorter than a predetermined length of time, issues a control signal for displaying the remaining quantity of print recording medium contained in a print recording medium reservoir installed on said carriage, corresponding to said identified print recording medium reservoir; and said output unit transmits said issued control signal to a display unit. Alternatively, said control signal issuing unit may issue a control signal for displaying the remaining quantity of print recording medium contained in said identified print recording medium reservoir, rather than the remaining quantity of print recording medium contained in a print recording medium reservoir installed on said carriage.

According to the printing device pertaining to the first aspect herein, in response to detecting proximity of a print recording medium reservoir and the duration of sustained proximity thereof, there is performed a process required to request display of the remaining quantity of print recording medium contained in the proximate print recording medium reservoir, or display of the remaining quantity of print recording medium contained in a print recording medium reservoir installed on said carriage, corresponding to the identified print recording medium reservoir. The display device may be a display device provided to the printing device, or an external display device separate from the printing device.

The printing device pertaining to the first aspect herein may further comprise a carriage having said print recording medium reservoir installed thereon and equipped with a print head; a carriage control unit for controlling operation of said carriage; an opening/closing operation detecting unit for detecting the opened/closed state of a cover that is opened and closed in the course of replacing said print recording medium reservoir; and an identifying unit for identifying said proximate print recording medium reservoir, wherein said event is the opening/closing operation of said cover; said control signal issuing unit, in the event that proximity of said print recording medium reservoir and opening of said cover is detected, issues a control signal for moving said carriage to the replacement location for a print recording medium reservoir installed on said carriage, corresponding to said identified print recording medium reservoir; and said output unit transmits said issued control signal to said carriage control unit.

According to the printing device pertaining to the first aspect herein, in response to detecting proximity of said print recording medium reservoir and the opened/closed state of the cover, the print recording medium reservoir on the carriage, corresponding to the proximate print recording medium reservoir is moved to the replacement location, whereby processing required for a request to replace print recording medium reservoir may be performed even if a print recording medium reservoir has not been installed, and erroneous insertion when swapping print recording medium reservoirs can be avoided.

The printing device pertaining to the first aspect herein may further comprise a carriage having said print recording medium reservoir installed thereon and equipped with a print head; an opening/closing operation detecting unit for detecting the opened/closed state of a cover that is opened and closed in the course of replacing said print recording medium reservoir; and an identifying unit for identifying said proximate print recording medium reservoir, wherein said event is the opening/closing operation of said cover; said control signal issuing unit, in the event that closing of said cover is detected at a point in time while said print recording medium reservoir is in proximity, issues a control signal for displaying the remaining quantity of print recording medium contained in a print recording medium reservoir installed on said carriage, corresponding to said identified print recording medium reservoir; and said output unit transmits said issued control signal to a display unit. Alternatively, said control signal issuing unit may issue a control signal for displaying the remaining quantity of print recording medium contained in said identified print recording medium reservoir, rather than the remaining quantity of print recording medium contained in a print recording medium reservoir installed on said carriage.

According to the printing device pertaining to the first aspect herein, in response to detecting proximity of said print recording medium reservoir and the opened/closed state of the cover, there can be performed a process required to request display of the remaining quantity of print recording medium contained in a print recording medium reservoir installed on the carriage. The display device may be a display device provided to the printing device, or an external display device separate from the printing device.

In a printing device pertaining to the first aspect herein, said transmitter-receiver may be an antenna for sending and receiving radio signals within close range, installed at a location enabling sending and receiving of data with a print recording medium reservoir on said carriage; and said proximity detecting unit may detect proximity of said print recording medium reservoir by detecting a signal transmitted by said print recording medium reservoir. With this arrangement, proximity of a print recording medium reservoir can be detected simply by providing a transmitter-receiver. The antenna may be disposed in a location enabling communication with both a print recording medium reservoir on the carriage and a proximate print recording medium reservoir.

In a printing device pertaining to the first aspect herein, said transmitter-receiver may be an antenna for sending and receiving radio signals with said proximate print recording medium reservoir and installed at a location enabling sending and receiving of data with a print recording medium reservoir on said carriage; and said proximity detecting unit may be a contact sensor disposed in proximity to said antenna, for detecting physical contact of said print recording medium reservoir with said printing device. With this arrangement, proximity of a print recording medium reservoir can be determined accurately.

The invention in a second aspect thereof provides a printing device for sending and receiving data, by means of a non-contact format, with a print recording medium reservoir equipped with a memory device. The printing device according to the second aspect herein comprises a transmitter-receiver for sending and receiving data; a proximity detecting unit for detecting proximity of a said print recording medium reservoir; an identifying unit for identifying said proximate print recording medium reservoir; a display device for displaying the remaining quantity of print recording medium contained in said print recording medium reservoir; a carriage having said print recording medium reservoir installed thereon and equipped with a print head; an event sensor for detecting an event; and a control unit for controlling said carriage or said display device in response to detecting proximity of said print recording medium reservoir and said event.

According to the printing device pertaining to the second aspect herein, a process required to make a request relating to a print recording medium reservoir may be performed in response to detecting proximity of a print recording medium reservoir and an event, even if a print recording medium reservoir has not been installed.

In a printing device pertaining to the second aspect herein, said event may be the duration of sustained proximity of said print recording medium reservoir; and said control unit, in the event that said duration of sustained proximity is shorter than a predetermined length of time, may cause the remaining quantity of print recording medium contained in a print recording medium reservoir installed on said carriage, corresponding to said identified print recording medium reservoir, to be displayed on said display unit. With this arrangement, a process required to request display of the remaining quantity of print recording medium contained in a print recording medium reservoir installed on said carriage, corresponding to said identified print recording medium reservoir, can be performed in response to detecting proximity of a print recording medium reservoir and the duration of sustained proximity thereof. Alternatively, the remaining quantity of print recording medium contained in the proximate print recording medium reservoir may be displayed on the display device.

In a printing device pertaining to the second aspect herein, said control unit, in the event that said duration of sustained proximity exceeds a predetermined length of time, may move said carriage to the replacement location for a print recording medium reservoir installed on said carriage, corresponding to said identified print recording medium reservoir. With this arrangement, a print recording medium reservoir installed on the carriage can be moved to a replacement location corresponding to an identified print recording medium reservoir, in response to detecting proximity of a print recording medium reservoir and the duration of sustained proximity thereof. Thus, processing required to request replacement of a print recording medium reservoir may be performed even if no print recording medium reservoir is installed, and erroneous insertion when replacing a print recording medium reservoir can be avoided.

The invention in a third aspect thereof provides a printing device for sending and receiving data, by means of a non-contact format, with a print recording medium reservoir equipped with a memory device. The printing device according to the third aspect herein comprises a transmitter-receiver for sending and receiving data; a proximity detecting unit for detecting proximity of a said print recording medium reservoir; an identifying unit for identifying said proximate print recording medium reservoir; a graduated scale portion having graduations indicating the remaining quantity of print recording medium contained in a print recording medium reservoir; a carriage having said print recording medium reservoir installed thereon and equipped with a print head; and a display control unit that, in the event that proximity of said print recording medium reservoir is detected, points to, by means of a print recording medium reservoir installed on said carriage, corresponding to said identified print recording medium reservoir, a graduation of said graduated scale portion that corresponds to the remaining quantity of print recording medium in said identified print recording medium reservoir.

According to the printing device pertaining to the third aspect herein, by means of detecting proximity of a print recording medium reservoir, the remaining quantity of print recording medium in a print recording medium reservoir on the carriage, corresponding to a proximate print recording medium reservoir, can be indicated by a graduated scale portion. Thus, processing required to display the remaining quantity of print recording medium in a print recording medium reservoir can be performed without inserting the print recording medium reservoir, and processing required to display the remaining quantity of print recording medium can be performed by the printing device alone, without the use of an external display device.

In a printing device pertaining to the third aspect herein, by means of a print recording medium reservoir corresponding to said identified print recording medium reservoir and installed on said carriage, said display control unit may indicate a graduation of said graduated scale portion corresponding to the remaining quantity of print recording medium in a print recording medium reservoir corresponding to said identified print recording medium reservoir and installed on said carriage, rather than indicating the remaining quantity of print recording medium in said identified print recording medium reservoir. With this arrangement, processing required to display the remaining quantity of print recording medium in a print recording medium reservoir can be accomplished by means of a simple operation.

In a printing device pertaining to the third aspect herein, said graduated scale portion may have expiration date graduations for indicating whether said print recording medium reservoir has not yet reached its expiration date or passed its expiration date, rather than indicating the remaining quantity of print recording medium in a print recording medium reservoir; and by means of a print recording medium reservoir corresponding to said identified print recording medium reservoir and installed on said carriage, said display control unit may indicate whether said identified print recording medium reservoir has not yet reached its expiration date or passed its expiration date, rather than indicating the remaining quantity of print recording medium. With this arrangement, information relating to the expiration date for a print recording medium reservoir can be displayed by means of a simple operation, without the need to open and install the print recording medium reservoir.

In a printing device pertaining to the third aspect herein, said graduated scale portion may have compatibility graduations for indicating whether a print recording medium reservoir is a print recording medium reservoir that is compatible with said printing device, rather than graduations for remaining quantity of print recording medium contained in the print recording medium reservoir; and by means of a print recording medium reservoir corresponding to said identified print recording medium reservoir and installed on said carriage, said display control unit may indicate whether said identified print recording medium reservoir is compatible with said printing device, rather than indicating the remaining quantity of print recording medium. With this arrangement, information relating to whether a print recording medium reservoir is compatible can be displayed by means of a simple operation, without opening or installing the print recording medium reservoir.

The invention in a fourth aspect thereof provides a method of controlling a printing device that sends and receives data, by means of a non-contact format, with a print recording medium reservoir equipped with a memory device and installed on a carriage. The method pertaining to the fourth aspect herein comprises detecting proximity of a said print recording medium reservoir; identifying said proximate print recording medium reservoir; measuring the duration of sustained proximity of said print recording medium reservoir; and moving a print recording medium reservoir installed on said carriage, which is corresponding to said identified print recording medium reservoir said carriage, to the replacement location, in the event that said measured duration of sustained proximity exceeds a predetermined length of time.

The method according to the fourth aspect herein may further comprises displaying on an external display device the remaining quantity of print recording medium contained in a printer recording medium reservoir installed on said carriage, corresponding to said identified printer recording medium reservoir, in the event that said duration of sustained proximity is shorter than a predetermined length of time.

According to the method that pertains to the fourth aspect herein, there are obtained working effects similar to the printing device which pertains to the first aspect herein; and like the printing device which pertains to the first aspect herein, the method that pertains to the fourth aspect herein may assume a number of embodiments.

The invention in a fifth aspect thereof provides a method of controlling a printing device that sends and receives data, by means of a non-contact format, with a print recording medium reservoir equipped with a memory device and installed on a carriage. The method pertaining to the fifth aspect herein comprises detecting proximity of a said print recording medium reservoir; identifying said proximate print recording medium reservoir; detecting an opening operation of a cover opened and closed in the course of replacing said print recording medium reservoir; and moving the print recording medium reservoir installed on said carriage, corresponding to said identified print recording medium reservoir, to the replacement location, in the event that proximity of said printer recording medium reservoir has been detected and an opening operation of said cover has been detected.

The method according to the fifth aspect herein may further comprise causing the remaining quantity of print recording medium contained in a print recording medium reservoir installed on said carriage, corresponding to said identified print recording medium reservoir, to be displayed on an external display device, in the event said cover is closed at a point in time while said print recording medium reservoir is in proximity.

According to the method that pertains to the fifth aspect herein, there are obtained working effects similar to the printing device which pertains to the second aspect herein; and like the printing device which pertains to the second aspect herein, the method that pertains to the fifth aspect herein may assume a number of embodiments.

The invention in a sixth aspect thereof provides a method of controlling a printing device that sends and receives data, by means of a non-contact format, with a print recording medium reservoir equipped with a memory, and that has a graduated scale portion having graduations indicating the remaining quantity of print recording medium contained in a print recording medium reservoir. The method pertaining to the sixth aspect herein comprises detecting proximity of a said print recording medium reservoir; identifying said proximate print recording medium reservoir; and indicating a said graduation corresponding to the remaining quantity of print recording medium in said identified printer recording medium reservoir, by means of a printer recording medium reservoir installed on the carriage, corresponding to said identified printer recording medium reservoir, in the event that proximity of said printer recording medium reservoir has been detected.

The method pertaining to the sixth aspect herein, said indicating step is a step of indicating, by means of a print recording medium reservoir corresponding to said identified print recording medium reservoir and installed on said carriage, a graduation corresponding to the remaining quantity of print recording medium in a print recording medium reservoir corresponding to said identified print recording medium reservoir and installed on said carriage, rather than indicating the remaining quantity of print recording medium in said identified print recording medium reservoir.

According to the method that pertains to the sixth aspect herein, there are obtained working effects similar to the printing device which pertains to the third aspect herein; and like the printing device which pertains to the third aspect herein, the method that pertains to the sixth aspect herein may assume a number of embodiments.

It should be understood that the present invention may be implemented as a computer-readable medium having recorded thereon control program instructions for a printing device.

BRIEF DESCRIPTION OF THE DRAWINGS

Specific details of the printing device and printing device control program of the present invention will be better elucidated through several embodiments described with reference to the accompanying drawings.

DETAILED DESCRIPTION OF THE PREFERRED EMBODIMENTS

First Embodiment

Figure 1:
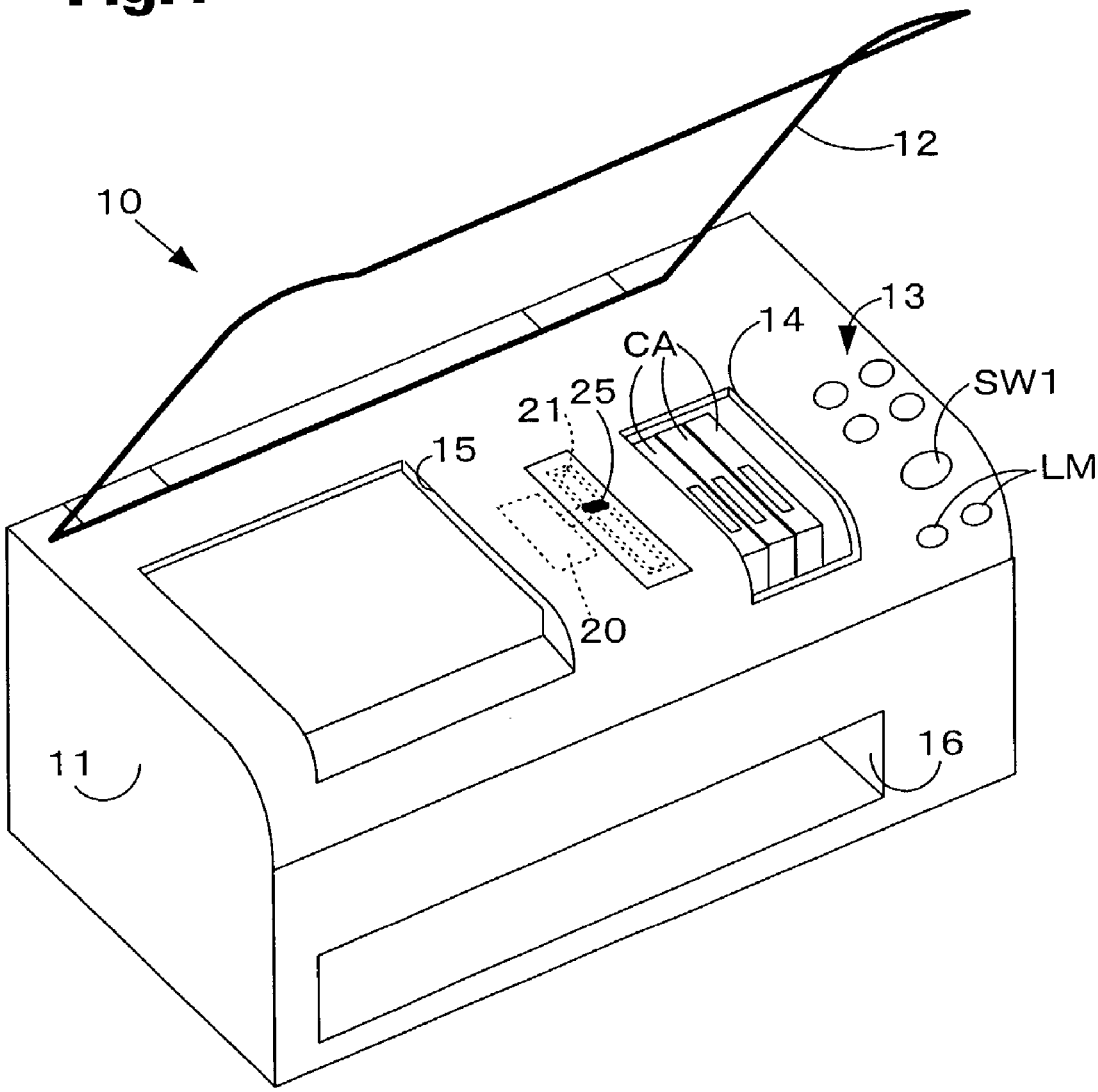
FIG. 1 is an illustration showing a simplified arrangement of a printing device (color printer) pertaining to first embodiment.
Figure 2:
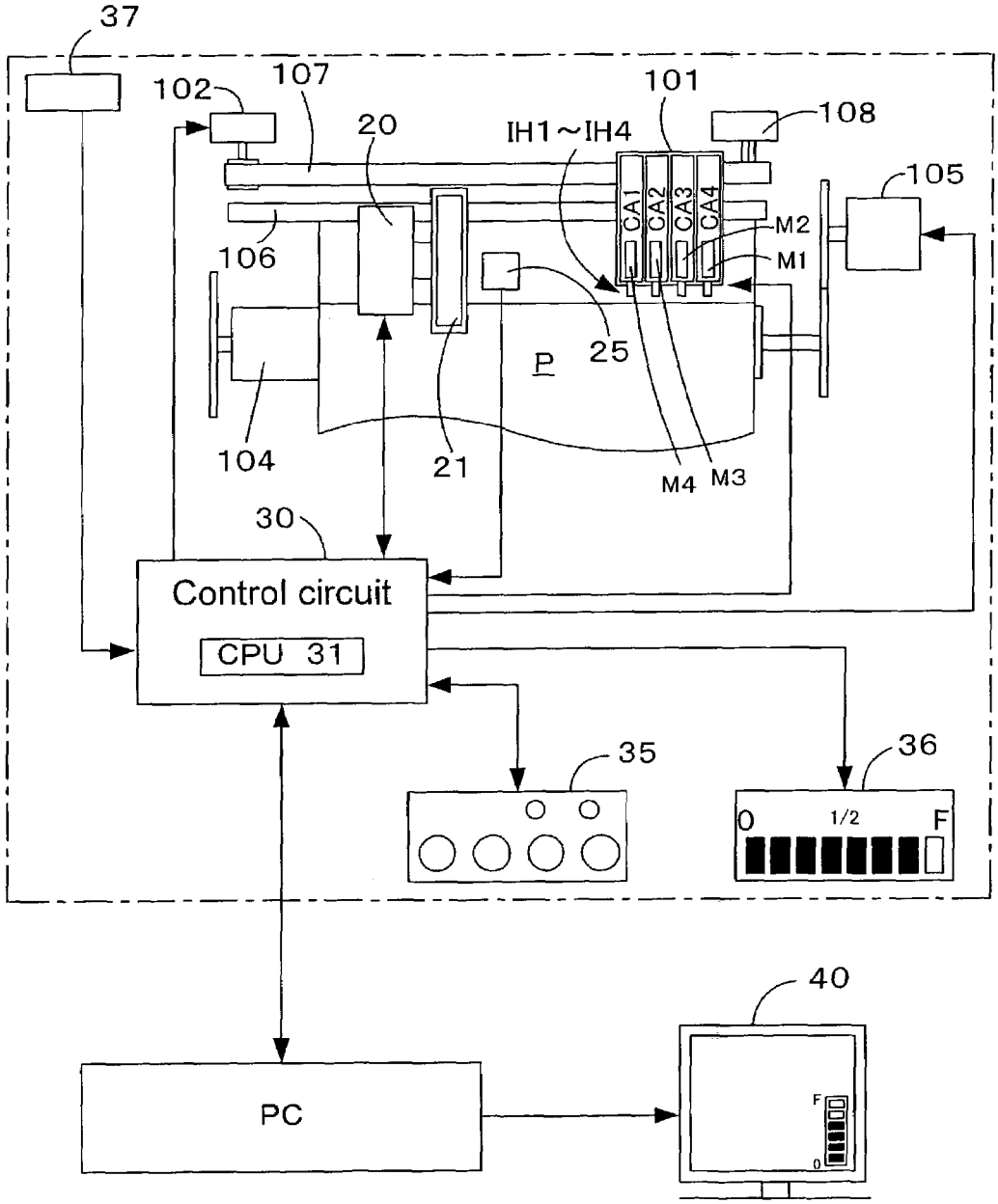
FIG. 2 is an illustration showing a simplified internal arrangement of a color printer pertaining to first embodiment, and the control arrangement therefor.

The following description of the general arrangement of a printing device pertaining to a first embodiment herein makes reference to FIGS. 1 and 2. FIG. 1 is an illustration showing a simplified arrangement of a printing device (color printer) pertaining to first embodiment. FIG. 2 is an illustration showing a simplified internal arrangement of a color printer pertaining to first embodiment, and the control arrangement therefor.

In the present embodiment, an ink-jet color printer 10 will be described by way of an exemplary printing device. Color printer 10 is a printer capable of color output, namely, an ink-jet printer for producing images by forming a dot pattern of inks of four colors, for example, cyan (C), magenta (M), yellow (Y) and black (K), ejected onto a print medium. In addition to these four colors, colored inks such as light cyan (LC), light magenta (LM), dark yellow (DY), or light black (LB) may be used. Print recording medium (ink) is housed in printer recording medium reservoirs (ink cartridges CA). While the present embodiment is described in terms of an ink-jet color printer, an electro-photographic printer, which transfers and fixes colored toner onto a print medium, could be used as well.

As shown in FIG. 1, color printer 10 has a chassis 11 housing a print function section, and a cover 12 which is opened and closed when replacing an ink cartridge CA. On the upper face of chassis 11 are provided a control panel 13 having a power switch SW1, indicator lamps LM etc.; a replacement opening 14 for removing and installing ink cartridges CA during ink cartridge replacement; and a maintenance opening 15. On the front face of chassis 11 is provided a paper discharge opening 16 through which is discharged printed paper having been supplied through a paper feed opening, not shown.

Referring now to FIG. 2, color printer 10 also comprises a mechanism for driving print heads IH1-IH4 which are installed on a carriage 101, so that ink is ejected from the heads to produce dots; a mechanism for reciprocating carriage 101 in the axial direction of a platen 104 by means of a carriage motor 102; a mechanism for advancing printer paper P by means of a paper feed motor 105; and a control circuit 30. The mechanism for reciprocating carriage 101 in the axial direction of platen 104 comprises a slide rail 106 extending parallel to the axis of platen 104, for slidably retaining carriage 101; a pulley 108 having an endless drive belt installed extending between it and carriage motor 103; and a position sensor (not shown) for detecting the home position of carriage 101. The mechanism for advancing printer paper P comprises platen 104; a paper feed motor 105 for rotating platen 104; an auxiliary paper feed roller, not shown; and a gear train (not shown) for transmitting rotation of the paper feed motor 105 to platen 104 and the auxiliary paper feed roller.

Ink cartridges CA1-CA4 are installed on carriage 101. Ink cartridge CA1 contains black (K) ink, ink cartridge CA2 contains cyan (C) ink, ink cartridge CA3 contains magenta (M) ink, and ink cartridge CA4 contains yellow (Y) ink. As noted, ink cartridges CA containing light cyan (LC) ink, light magenta (LM) ink, dark yellow (DY) ink, or light black (LB) may be installed as well.

In lieu of contact terminals, each ink cartridge CA1-CA4 is provided with a memory device module M1-M4 comprising a coil antenna, for sending and receiving radio signals. Each memory device module M1-M4 is operated by electrical power, produce by induced electromotive force created when the antenna comes into proximity with a radio wave. Ink cartridge CA1 contains black (K) ink, ink cartridge CA2 contains cyan (C) ink, ink cartridge CA3 contains magenta (M) ink, and ink cartridge CA4 contains yellow (Y) ink. As noted, ink cartridges CA containing light cyan (LC) ink, light magenta (LM) ink, dark yellow (DY) ink, or light black (LB) may be installed as well.

Control circuit 30 is a circuit for controlling the printing process, ink cartridge replacement process, and other processes in color printer 10. Specifically, operations of paper feed motor 105, carriage motor 103, and print heads 102 are controlled by a CPU 31. Control circuit 30 is connected to an RF circuit 20, a contact detecting switch 25, control panel 13, an internal display device 36, a cover open/close detecting switch 37, and a personal computer PC. Where color printer 10 functions as a stand-alone printer, it need not be connected to a personal computer PC.

RF circuit 20 is a circuit for controlling sending and receiving of data with the memory device modules M1-M4 of the ink cartridges CA, performed in wireless format via an antenna 21. When contact detecting switch 25 detects proximity of an ink cartridge CA, RF circuit 20 begins to output a carrier wave via antenna 21, and once reduced amplitude of the carrier wave is detected, begins to send and receive data with the memory device modules M1-M4. As noted, memory device modules M1-M4 generate the required power using the carrier wave, so once memory device modules M1-M4 generate power (become a load) and memory device modules M1-M4 assume an operational state, carrier wave amplitude drops.

As will be understood from FIG. 4, which shall be referred to in the following description, antenna 21 is disposed in a location enabling both sending and receiving of data with the memory device modules M1-M4 of ink cartridges CA installed on carriage 101, and sending and receiving of data with proximate (external) ink cartridges CA. Accordingly, it is possible to hold the number of antennas required to one.

Internal display device 36 is a display device provided to the color printer 10, and is used for displaying various messages such as remaining quantity of ink in an ink cartridge CA, compatibility of a particular ink cartridge CA with color printer 10, and the like. Cover open/close detecting switch 37 consists, for example, of an ON/OFF switch, for detecting whether cover 12 is open or closed.

The description in this first embodiment assumes that color printer 10 is connected to a personal computer PC. Personal computer PC is in turn connected to an external display device 40 for displaying a user interface for displaying color printer 10 operating status and information relating to the ink cartridges CA. Personal computer PC executes ink cartridge identification processes and printing device control processes on the basis of a program stored in an internal or external memory device (recording medium) HD, and sends printing device control signals to the control circuit 30. Accordingly, the control circuit 30 controls operation of the various components of printer 10 in accordance with control signals received from the personal computer PC.

In the event of a data read/write to memory device module M1 of ink cartridge CA1, for example, the control circuit 30 controls driving of the carriage 101 so as to move ink cartridge CA1 directly below antenna 21. Control circuit 30 then performs data communication via antenna 21 with the memory device module M1 of ink cartridge CA1 situated directly below antenna 21. Naturally, the distance between antenna 21 and the memory device module M1 of ink cartridge CA1 will be such that sending and receiving of data is possible (i.e. a distance within communication range). Control circuit 30 performs data read/write operations with other ink cartridges CA2-4 in the same manner.

Figure 3:
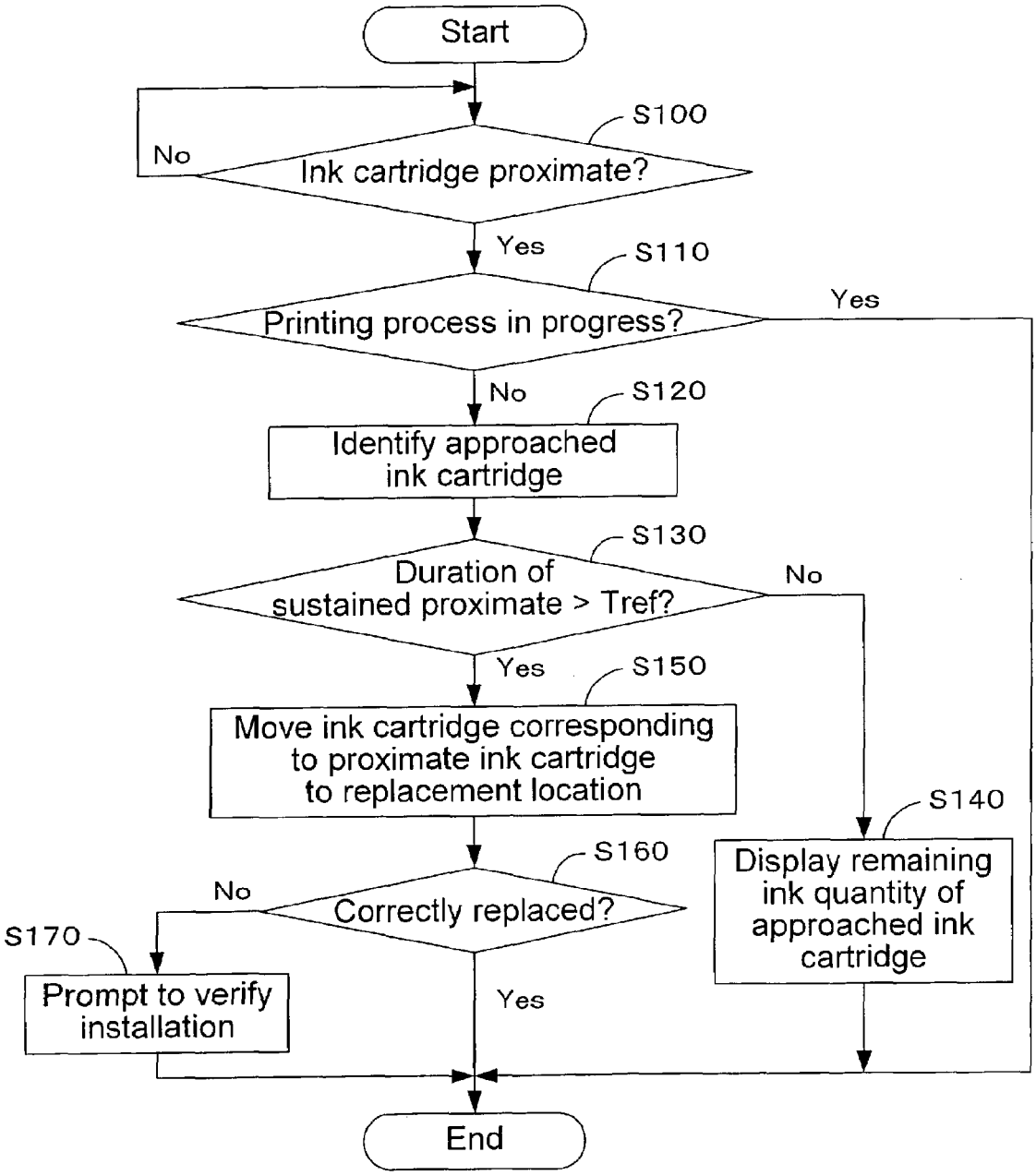
FIG. 3 is a flow chart showing a processing routine for a printing device control process executed in color printer 10 pertaining to first embodiment.
Figure 4:
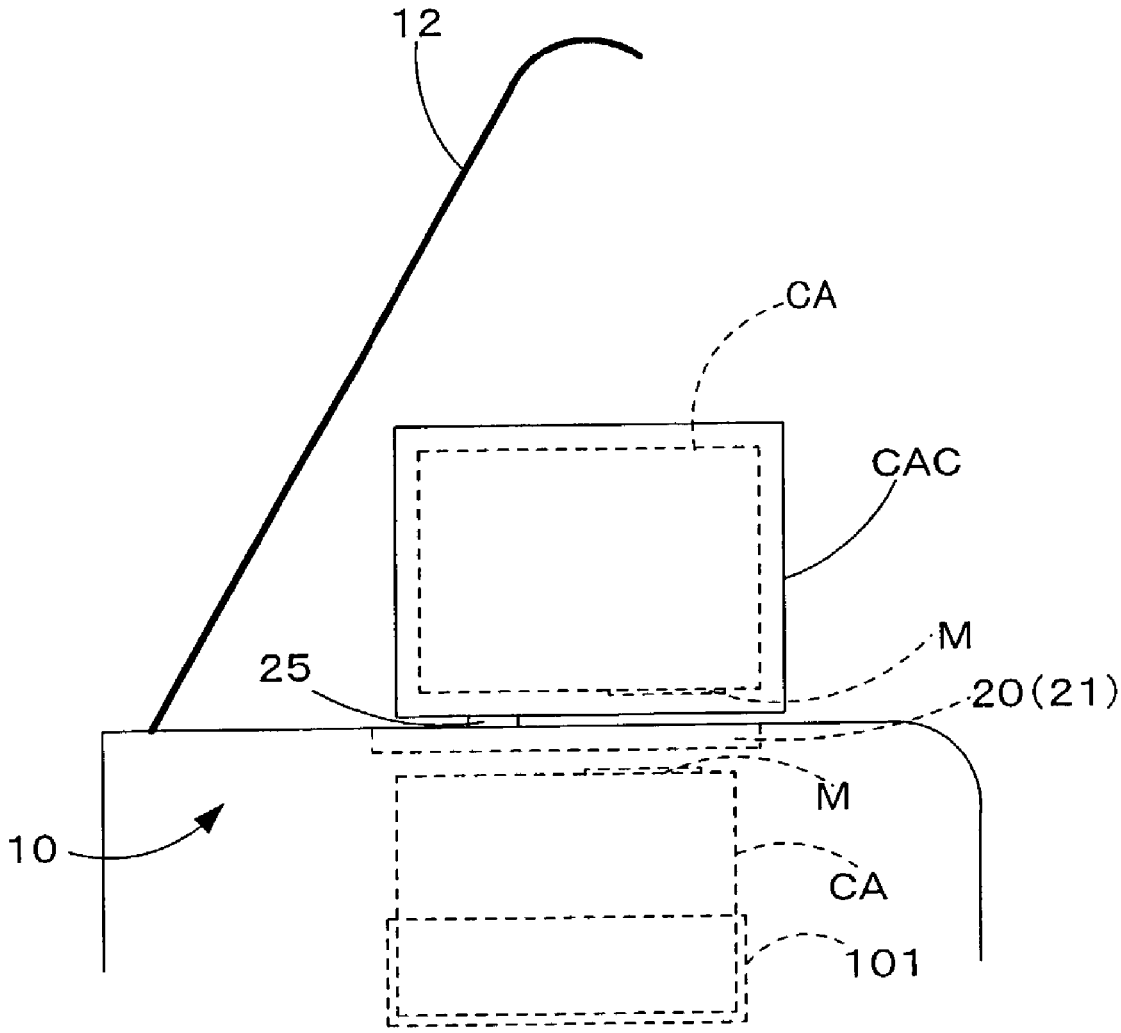
FIG. 4 illustrates an example of an ink cartridge CA, still contained in its packaging carton CAC, placed in proximity to color printer 10.
Figure 5:
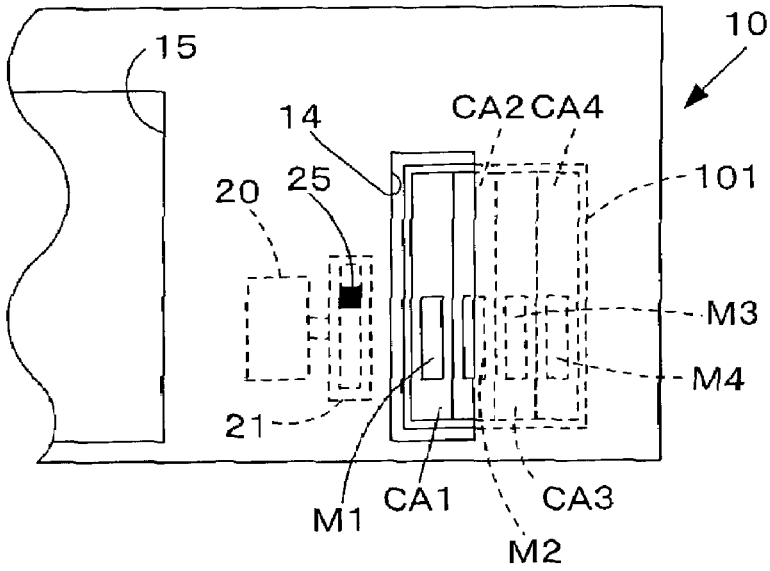
FIG. 5 illustrates an ink cartridge CA1 being moved to the replacement location.
Figure 6:
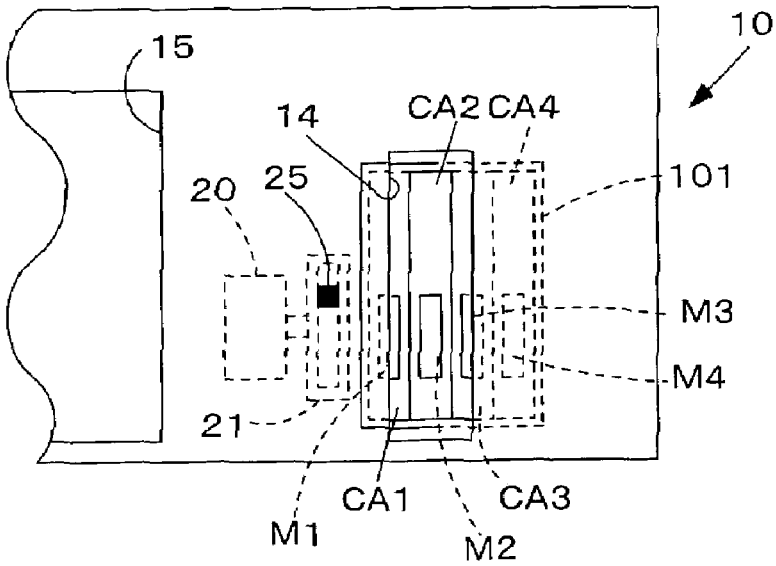
FIG. 6 illustrates another ink cartridge CA2 being moved to the replacement location.

The following description of printing device control processes performed in color printer 10 pertaining to first embodiment makes reference to FIGS. 3-6. FIG. 3 is a flow chart showing a processing routine for a printing device control process executed in color printer 10 pertaining to first embodiment. FIG. 4 illustrates an example of an ink cartridge CA, still contained in its packaging carton CAC, placed in proximity to color printer 10. FIG. 5 illustrates an ink cartridge CA1 being moved to the replacement location. FIG. 6 illustrates another ink cartridge CA2 being moved to the replacement location.

As shown in FIG. 4, until contact detecting switch 25 has been switched ON (depressed) by ink cartridge CA (packaging carton CAC), i.e. until proximity of an ink cartridge CA to color printer 10 is detected, personal computer PC waits in standby mode (Step S100: No). Once proximity of an ink cartridge CA to color printer 10 is detected (Step S100: Yes), personal computer PC determines whether any print jobs are currently being processed (Step S110). In FIG. 4 the ink cartridge CA is shown for exemplary purposes as still contained in its packaging carton CAC, but the ink cartridge CA could also be removed from its packaging carton CAC for use. The installation face of memory device module M of the ink cartridge CA is indicated on the packaging carton CAC containing it.

In the event that personal computer PC determines that a print job is currently being processed (Step S110: Yes), it terminates the processing routine, since the ink cartridge replacement operation cannot be performed at this time. Alternatively, it may wait for the print job to finish, and then execute the process.

In the event that personal computer PC determines that no print jobs are currently being processed (Step S110: No), it identifies the proximate ink cartridge CA (Step S120). Each ink cartridge CA1-CA4 (memory device module M1-M4) is assigned a unique identifier symbol enabling ink color, ink type and the like to be identified through the identifier symbol. That is, ink cartridges for replacement on carriage 101 are identified.

Personal computer PC then determines whether the time interval over which ink cartridge CA is maintained in a proximate location (duration of sustained proximity) is longer than a predetermined time interval Tref (Step S130). If the duration of sustained proximity is less than predetermined time interval Tref (Step S130: No), personal computer PC reads out the remaining quantity of ink from the memory device module M1 of ink cartridge CA1 and displays this on external display device 40 (Step S140). That is, where the duration of sustained proximity is less than predetermined time interval Tref, personal computer PC will make a determination that the purpose is to acquire information about the proximate ink cartridge CA.

If on the other hand the duration of sustained proximity is longer than predetermined time interval Tref (Step S130: Yes), personal computer PC drives the carriage 101 so as to move an ink cartridge CA installed on carriage 101, which cartridge corresponds to the proximate ink cartridge CA, to the replacement opening 14, as shown in FIGS. 5 and 6 (Step S150). FIG. 5 shows operation of carriage 101 where ink cartridge CA1 has been brought into proximity with printer 10; and FIG. 6 shows operation of carriage 101 where ink cartridge CA2 has been brought into proximity with printer 10.

Once the ink cartridge CA has been replaced, personal computer PC determines whether ink cartridge CA has been properly installed, and whether the ink cartridge CA installed on the basis of its identifier symbol is in fact the correct ink cartridge (Step S160). In the event that personal computer PC determines that the ink cartridge CA has not been replaced correctly (Step S160: No), it displays on external display device 40 a message prompting the user to verify the installation (Step S170) and terminates the processing routine.

In the event that personal computer PC determines that the ink cartridge CA has been replaced correctly (Step S160: Yes), it terminates the processing routine. If the ink cartridge CA has not been replaced correctly, personal computer PC will not operate the color printer 10 until correct replacement (installation) has been completed. If the power to the color printer 10 is turned off with a cartridge incorrectly installed, once the power is turned on again, the personal computer will again display on external display device 40 a message prompting the user to verify the installation, and will not operate the color printer 10 until the improper installation is corrected.

According to the printing device control process pertaining to first embodiment, the determination as to whether the act of placing an ink cartridge CA into proximity is intended to request replacement of the ink cartridge CA or to request information regarding the ink cartridge CA (such as remaining ink quantity, for example) is made in response to an ink cartridge CA being placed in proximity and to a subsequent event (i.e. the duration of sustained proximity). Accordingly, personal computer PC is able to cause color printer 10 to execute operations required for replacing an ink cartridge CA, or to execute processes required to provide information regarding an ink cartridge CA, without the need to install the ink cartridge CA in the color printer 10 or to perform a button operation on the control panel 13. As a result, the user may be provided with the desired process by means of a visual procedure and simple operation, namely, bringing the target ink cartridge CA into proximity with the color printer 10.

Additionally, since the ink cartridge CA to be replaced is moved to the replacement opening 14, erroneous replacement (erroneous insertion) of ink cartridges CA can be avoided, even where several ink cartridges CA1-CA4 are installed on carriage 101.

Further, since an ink cartridge CA need not be physically installed in color printer 10 in order to obtain information about the proximate ink cartridge CA, the waste of ink associated with the cleaning operation performed when a new ink cartridge CA is installed may be avoided.

In first embodiment, the remaining quantity of ink in proximate ink cartridge CA is displayed on external display device 40, but instead the remaining quantity of ink in an ink cartridge CA installed on carriage 101 and corresponding to the proximate ink cartridge CA could be displayed on external display device 40. This allows visual confirmation of whether enough ink is left in an ink cartridge CA on carriage 101 to complete a print job which one desires to send to the printer.

In the preceding description, information regarding an ink cartridge CA is the remaining ink quantity, but instead the external display device 40 could display information indicating whether the expiration date has passed, or whether the particular ink cartridge CA is compatible with the color printer 10. In the present embodiment, the RF circuit 20 begins to output a carrier wave once the contact detecting switch 25 has gone ON, but an arrangement whereby a carrier wave is constantly output could be adopted as well.

Second Embodiment

Figure 7:
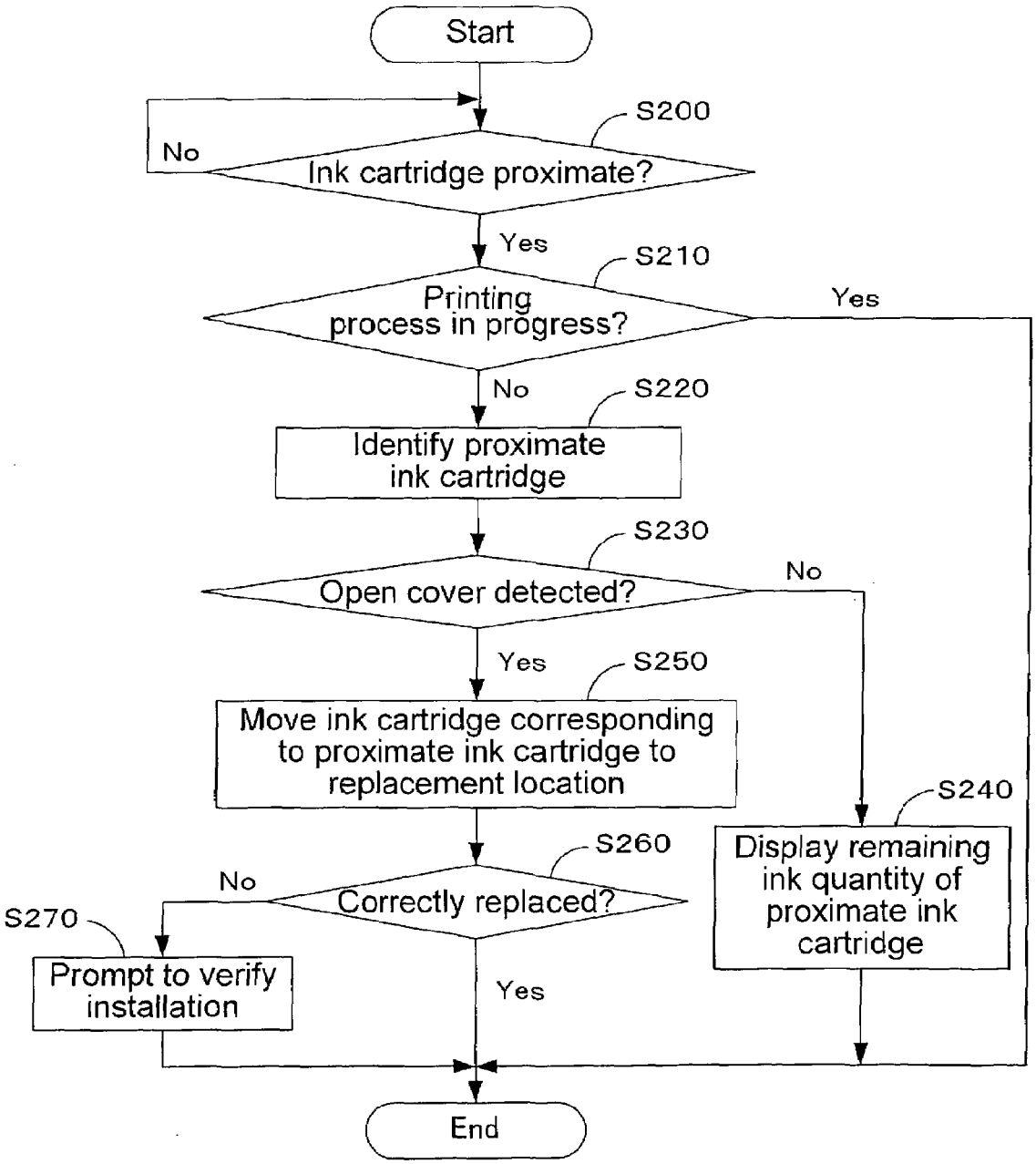
FIG. 7 is a flow chart showing a processing routine for a printing device control process executed in color printer 10 pertaining to second embodiment.

The following description of a printing device control process pertaining to a second embodiment herein makes reference to FIG. 7. FIG. 7 is a flow chart showing a processing routine for a printing device control process executed in color printer 10 pertaining to second embodiment. The arrangement of the color printer 10 which executes the control process pertaining to second embodiment is similar to the arrangement of the color printer 10 pertaining to first embodiment, with the exception that non-contact detecting switch 25 is provided; accordingly, similar components shall be assigned identical symbols and not described is detail. The color printer 10 pertaining to the present embodiment is not connected to a personal computer PC, and the control process pertaining to the present embodiment is executed by the control circuit 30. The RF circuit 20 constantly outputs a carrier wave via the antenna 21.

Until proximity of an ink cartridge CA to color printer 10 is detected, the CPU 31 of control circuit 30 waits in standby mode (Step S200: No). Once proximity of an ink cartridge CA to color printer 10 is detected (Step S200: Yes), CPU 31 determines whether any print jobs are currently being processed (Step S210). By detecting reduced amplitude of the carrier wave output by RF circuit 20, CPU 31 detects that an ink cartridge CA has been placed in proximity to color printer 10. RF circuit 20 is capable of communicating with memory device module M even with the cover 12 closed.

In the event that CPU 31 determines that a print job is currently being processed (Step S210: Yes), it terminates the processing routine, since the ink cartridge replacement operation cannot be performed at this time. Alternatively, it may wait for the print job to finish, and then execute the process.

In the event that CPU 31 determines that no print jobs are currently being processed (Step S210: No), it identifies the proximate ink cartridge CA (Step S220). The identification procedure is the same as in first embodiment.

CPU 31 then determines whether cover 12 is open (Step S230). If cover 12 is open, typically, the user intends to replace an ink cartridge CA, whereas if the cover is closed, the user probably intends some other operation besides replacing an ink cartridge CA, which serves as the basis for this determination. If CPU 31 determines that the cover is not open (Step S230: No), CPU 31 reads out the remaining ink quantity from the memory device module M of the proximate ink cartridge CA, and displays this on the internal display device 36.

If CPU 31 determines that the cover is open (Step S230: Yes), CPU 31 drives the carriage 101 so as to move an ink cartridge CA installed on carriage 101, which cartridge corresponds to the proximate ink cartridge CA, to the replacement opening 14, as shown in FIGS. 5 and 6 (Step S250).

Once the ink cartridge CA has been replaced, CPU 31 determines whether ink cartridge CA has been properly installed, and whether the ink cartridge CA installed on the basis of its identifier symbol is in fact the correct ink cartridge (Step S260). In the event that CPU 31 determines that the ink cartridge CA has not been replaced correctly (Step S260: No), it displays on internal display device 36 a message prompting the user to verify the installation (Step S270) and terminates the processing routine.

In the event that CPU 31 determines that the ink cartridge CA has been replaced correctly (Step S260: Yes), it terminates the processing routine.

According to the color printer 10 pertaining to second embodiment, the determination as to whether the act of placing an ink cartridge CA in proximity is intended to request replacement of the ink cartridge CA or to request information regarding the ink cartridge CA (such as remaining ink quantity, for example) is made in response to an ink cartridge CA being placed in proximity and to an event (i.e. opening of the cover 12). Accordingly, in the event that cover 12 is open, color printer 10 is able to execute operations required for replacing an ink cartridge CA, or if cover 12 is closed, to execute processes required to provide information regarding an ink cartridge CA, without the need to install the ink cartridge CA in the color printer 10 or to perform a button operation via the control panel 13. As a result, the user may be provided with the desired process by means of a visual procedure and simple operation, namely, bringing the target ink cartridge CA into proximity with the color printer 10 or opening the cover 12.

Additionally, since the ink cartridge CA to be replaced is moved to the replacement opening 14, erroneous replacement (erroneous insertion) of ink cartridges CA can be avoided, even where several ink cartridges CA1-CA4 are installed on carriage 101.

In second embodiment, the remaining quantity of ink in proximate ink cartridge CA is displayed on internal display device 36, but instead the remaining quantity of ink in an ink cartridge CA installed on carriage 101 and corresponding to the proximate ink cartridge CA could be displayed on internal display device 36. In the present embodiment, color printer 10 is a stand-alone printer not connected to a personal computer PC, and the remaining ink quantity cannot be ascertained from an external display device 40. The arrangement is therefore particularly useful for allowing visual confirmation of whether enough ink is left in an ink cartridge CA on carriage 101 to complete a print job which one desires to send to the printer.

In the preceding description, information regarding an ink cartridge CA is the remaining ink quantity, but instead the internal display device 36 could display information indicating whether the expiration date has passed, or whether the particular ink cartridge CA is compatible with the color printer 10. While here the remaining ink quantity in a proximate ink cartridge CA is displayed by the internal display device 36, if the printer is connected to a personal computer PC, the printing device control process could be executed by the control circuit of color printer 10, and only information relating to ink cartridge CA displayed on an external display device 40.

In second embodiment, a carrier wave is constantly output by the RF circuit 20, but an arrangement whereby RF circuit 20 begins to output a carrier wave once a contact detecting switch 25 has gone ON could be adopted as well.

Third Embodiment

Figure 8:
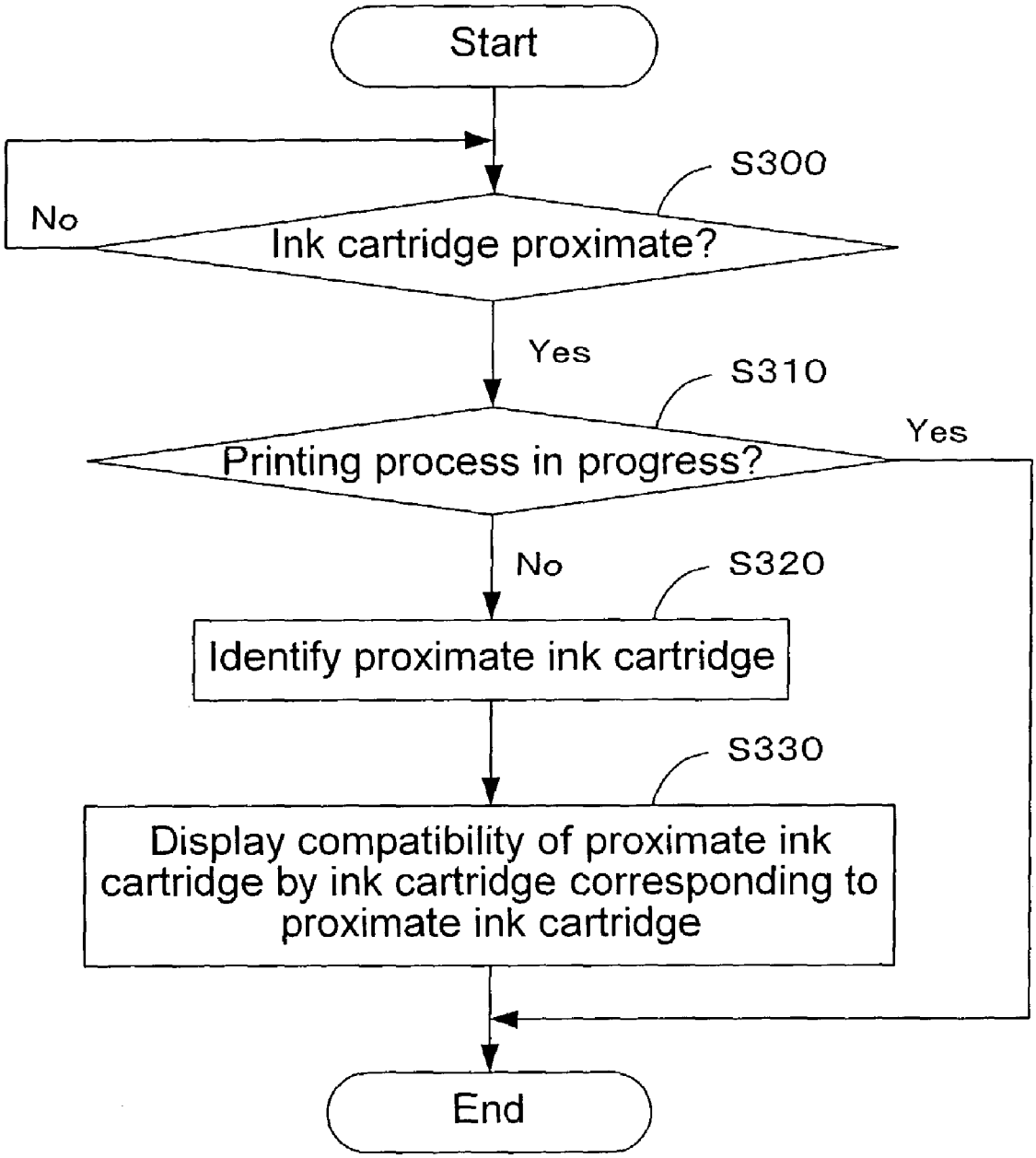
FIG. 8 is a flow chart showing a processing routine for a printing device control process executed in color printer 10 pertaining to third embodiment.
Figure 9:
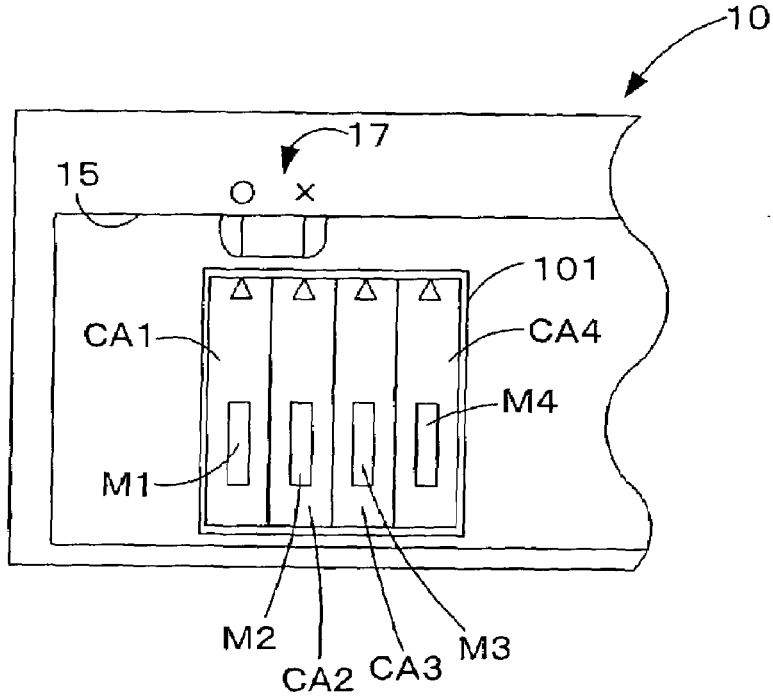
FIG. 9 is an illustration showing a graduated scale portion, provided to color printer 10 for indicating compatibility, being pointed to by means of a corresponding ink cartridge CA.

The following description of a printing device control process pertaining to a third embodiment herein makes reference to FIGS. 8 and 9. FIG. 8 is a flow chart showing a processing routine for a printing device control process executed in color printer 10 pertaining to third embodiment. FIG. 9 is an illustration showing a graduated scale portion, provided to color printer 10 for indicating compatibility, being pointed to by means of a corresponding ink cartridge CA. The arrangement of the color printer 10 which executes the control process pertaining to third embodiment is similar to the arrangement of the color printer 10 pertaining to first embodiment, with the exception that there is provided a graduated scale portion 17 for indicating information relating to ink cartridge CA, by means of an ink cartridge CA installed on carriage 101; accordingly, similar components shall be assigned identical symbols and not described is detail. The color printer 10 pertaining to the present embodiment is not connected to a personal computer PC, and the control process pertaining to the present embodiment is executed by the control circuit 30.

Until contact detecting switch 25 has been switched ON, i.e. proximity of an ink cartridge CA to color printer 10 has been detected, the CPU 31 of control circuit 30 waits in standby mode (Step S300: No). Once proximity of an ink cartridge CA to color printer 10 is detected (Step S300: Yes), CPU 31 determines whether any print jobs are currently being processed (Step S310).

In the event that CPU 31 determines that a print job is currently being processed (Step S310: Yes), it terminates the processing routine, since the ink cartridge replacement operation cannot be performed at this time. Alternatively, it may wait for the print job to finish, and then execute the process.

In the event that CPU 31 determines that no print jobs are currently being processed (Step S310: No), it identifies the proximate ink cartridge CA (Step S320). The identification procedure is the same as in first embodiment.

CPU 31 then reads out the compatible printer model from the memory device module M of the proximate ink cartridge CA, and determines whether the ink cartridge CA is compatible with color printer 10. As shown in FIG. 9, CPU 31 indicates a graduation on the graduated scale portion corresponding to the determination (O indicating compatibility and X indicating incompatibility) by means of the ink cartridge CA installed on carriage 101 corresponding to the proximate ink cartridge CA (Step S340), and terminates the processing routine.

According to the color printer 10 and printing device control program pertaining to third embodiment, it can be determined whether an ink cartridge CA is compatible with color printer 10 simply by bringing it into proximity with color printer 10. Accordingly, compatibility of an ink cartridge CA can be ascertained without the user having to open the ink cartridge CA package and install it in the printer. As a result, it is now possible to replace an ink cartridge CA, which in the past has been difficult due to the need to open the package and install the cartridge in the printer.

According to the color printer 10 which pertains to third embodiment, a graduated scale portion 17 for indicating, by means of an ink cartridge CA on carriage 101, information relating to an ink cartridge CA is provided on chassis 11, whereby information relating to an ink cartridge CA can be provided without the need to furnish a personal computer PC and external display device 40.

Additionally, as information, such as compatibility, relating to an ink cartridge CA is indicated by an ink cartridge CA on carriage 101 that corresponds to a proximate ink cartridge CA, correct ink cartridge CA classification can be verified visually.

In third embodiment, no determination is made as to whether the act of placing an ink cartridge CA in proximity is intended to request replacement of the ink cartridge CA or to request information regarding the ink cartridge CA, but it would of course be possible to make such a determination.

Figure 10:
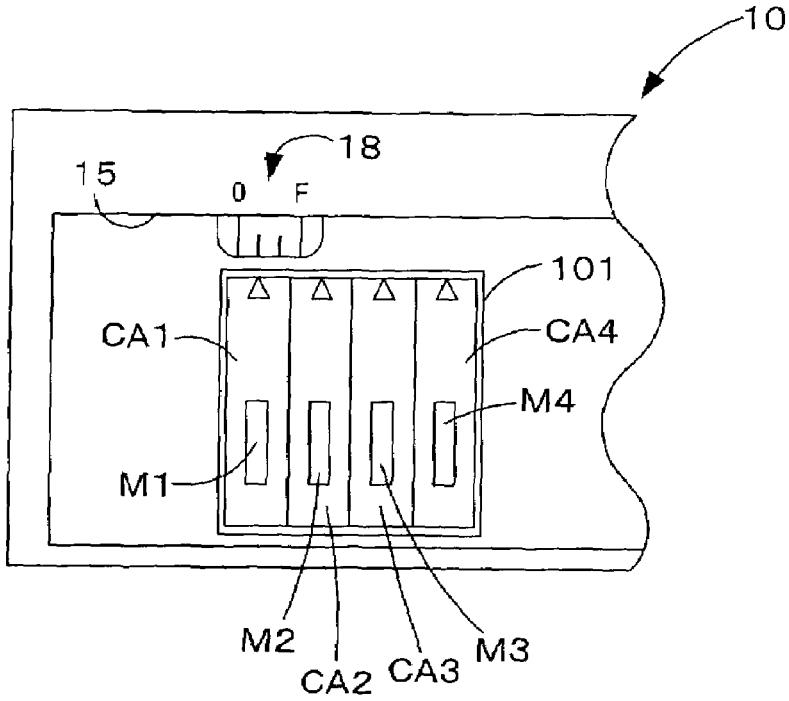
FIG. 10 is an illustration showing a graduated scale portion 18, provided to color printer 10 for indicating remaining ink quantity, being pointed to means of a corresponding ink cartridge CA.

In third embodiment, there is provided a graduated scale portion 17 for indicating compatibility of an ink cartridge CA, but it would instead be possible to provide a graduated scale portion 18 for indicating remaining ink quantity, as shown in FIG. 10. FIG. 10 is an illustration showing a graduated scale portion 18, provided to color printer 10 for indicating remaining ink quantity, being pointed to means of a corresponding ink cartridge CA. Alternatively, a graduated scale portion 17 indicating ink cartridge CA compatibility and a graduated scale portion 18 indicating remaining ink quantity could both be provided, or a single graduated scale portion having both functions could be provided. Besides ink cartridge CA compatibility and remaining ink quantity, a graduated scale portion for ink cartridge CA expiration date could be provided.

In the present embodiment, the RF circuit 20 begins to output a carrier wave once the contact detecting switch 25 has gone ON, but an arrangement whereby a carrier wave is constantly output could be adopted as well.

While the printing device and printing device control program pertaining to the invention have been shown and described hereinabove through certain preferred examples, these are merely illustrative and should not be construed as limiting the invention. Various modifications and improvements to the invention will be apparent to the skilled practitioner without departing from the spirit and scope of the invention as set forth in the claims, and such equivalents are course included within the present invention.

The contact detecting switch 25 employed in Embodiments 1 and 3 detects a physical depressing operation, but is not limited thereto and may instead detect proximity of an ink cartridge CA through optical means.

What is claimed is:

1. A printing device comprising:

a transmitter-receiver for sending and receiving data with a print recording medium reservoir using a non-contact format;

a proximity detecting unit for detecting proximity of said print recording medium reservoir;

an event sensor for detecting an event;

a control signal issuing unit for issuing a control signal in response to detecting proximity of said print recording medium reservoir and said event;

an output unit for outputting said issued control signal;

a carriage having said print recording medium reservoir installed thereon and equipped with a print head;

a carriage control unit for controlling operation of said carriage;

an opening/closing operation detecting unit for detecting the opened/closed state of a cover that is opened and closed in the course of replacing said print recording medium reservoir; and an identifying unit for identifying a proximate print recording medium reservoir, which is disposed outside of said printing device, wherein said event is the opening/closing operation of said cover;

said control signal issuing unit, in the event that proximity of said proximate print recording medium reservoir and opening of said cover is detected, issues a control signal for moving said carriage to a replacement location for a print recording medium reservoir installed on said carriage, corresponding to said identified proximate print recording medium reservoir; and said output unit transmits said issued control signal to said carriage control unit.

* * * * *